United States Patent [19]

Hohn

[11] 4,390,226

[45] Jun. 28, 1983

[54] ELECTRICAL PLUG FOR A RECEPTACLE HAVING A PLURALITY OF CONTACT PINS

[76] Inventor: Cletus R. Hohn, 4156 Eggers Dr., Fremont, Calif. 94536

[21] Appl. No.: 225,983

[22] Filed: Jan. 19, 1981

[51] Int. Cl.[3] ..... H01R 13/629

[52] U.S. Cl. ..... 339/89 M; 339/75 M

[58] Field of Search ..... 339/39, 75 R, 75 P, 339/75 M, 89 R, 89 M

[56] References Cited

U.S. PATENT DOCUMENTS

| | | | |
|---|---|---|---|
| 1,658,522 | 2/1928 | Frogue et al. | 339/213 R |
| 2,198,504 | 4/1940 | Pool | 173/343 |
| 2,590,505 | 3/1952 | Carlsen | 339/75 P |
| 3,052,867 | 9/1962 | Rogoff | 339/217 |
| 3,094,365 | 6/1963 | Chamberlain et al. | 339/75 R |
| 3,229,240 | 1/1966 | Harrison, Sr. et al. | 339/170 |
| 3,491,329 | 1/1970 | Lecocq | 339/75 R |
| 3,891,289 | 6/1975 | Hanke | 339/75 P |
| 4,072,381 | 2/1978 | Burkhart et al. | 339/39 |

FOREIGN PATENT DOCUMENTS

| | | | |
|---|---|---|---|
| 2502909 | 7/1976 | Fed. Rep. of Germany | 339/75 M |
| 2344148 | 3/1974 | France . | |
| 275959 | 6/1951 | Switzerland | 339/89 R |

*Primary Examiner*—John McQuade

*Attorney, Agent, or Firm*—Robert W. Dilts

[57] ABSTRACT

This disclosure describes electrical connectors of the mating plug and receptacle type that utilize a plurality of contact pin and socket connectors. The mating plug 10 contains a plurality of non-conductive followers 25 that each engage a cam surface 37 on the inner sidewall of a shield 30. When the electrical plug 10 is inserted into a receptacle 44 and the shield 30 is rotated and then slightly withdrawn, the followers 25 are urged by the cam surface 37 to press against the socket contact assemblies 18 which in turn more tightly engage the contact pins 18 of the receptacle 44.

8 Claims, 10 Drawing Figures

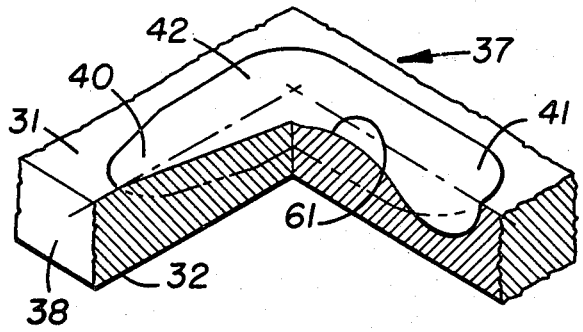
FIGURE 4
FIGURE 3
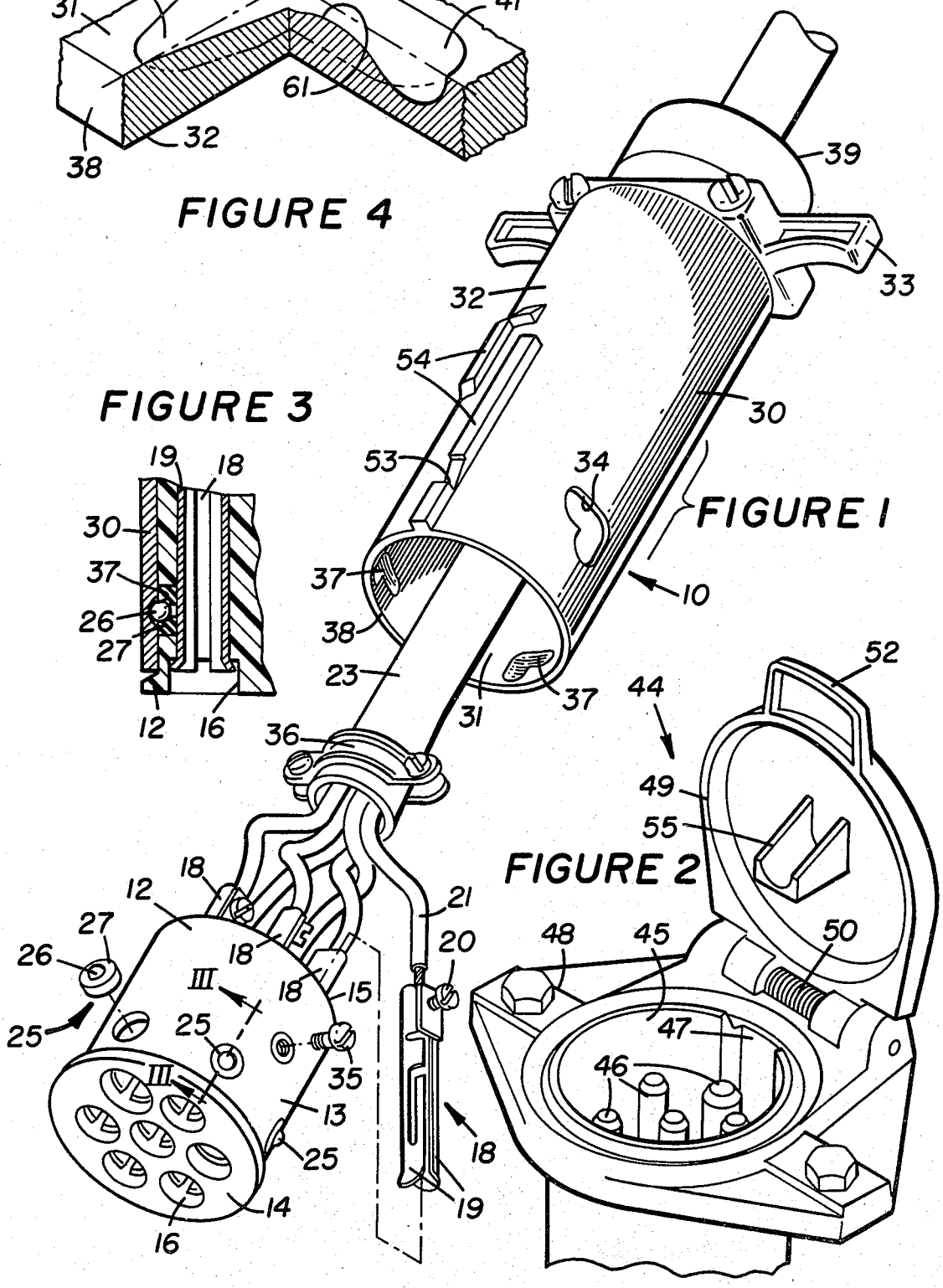
FIGURE 1
FIGURE 2

FIGURE 5
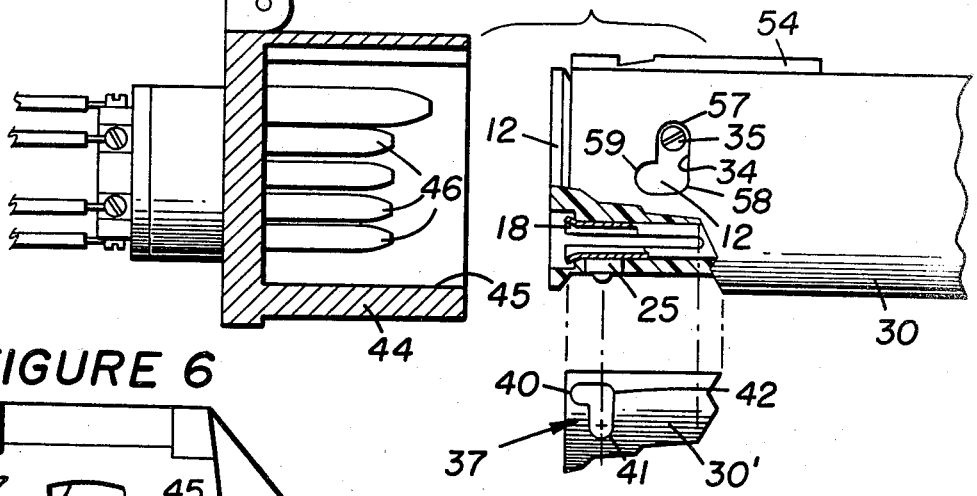
FIGURE 6
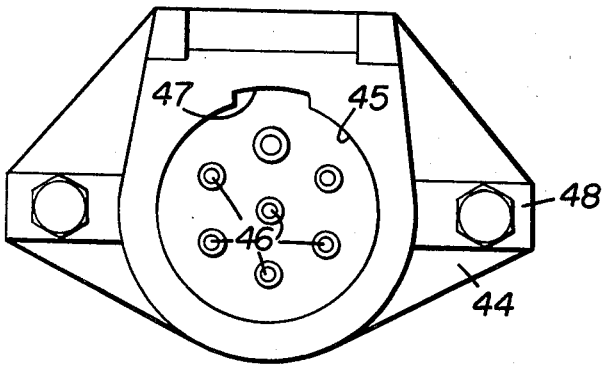
FIGURE 9
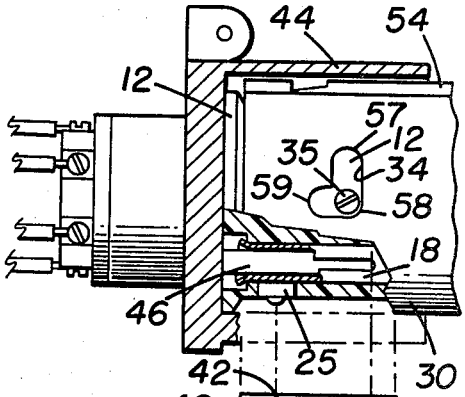
FIGURE 7
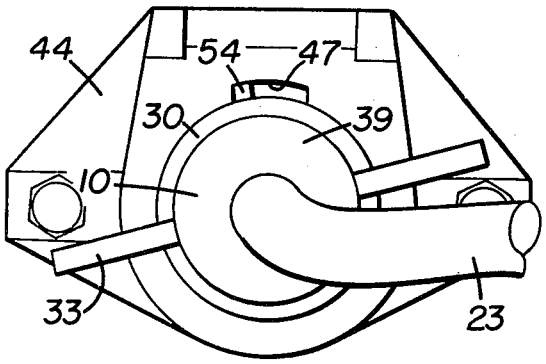
FIGURE 8
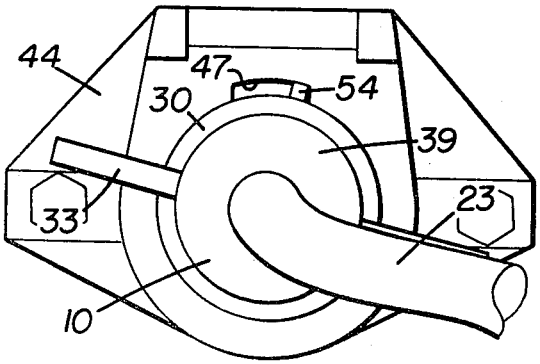
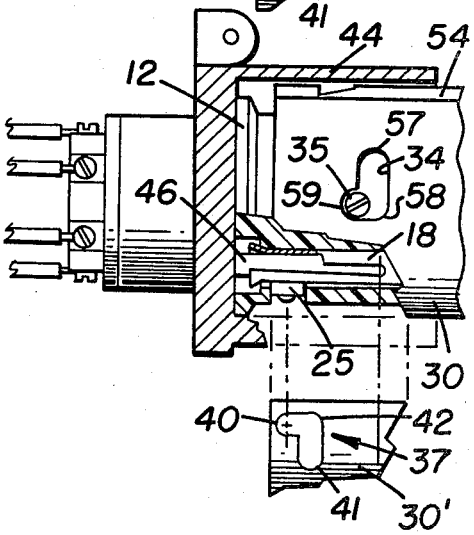
FIGURE 10

ELECTRICAL PLUG FOR A RECEPTACLE HAVING A PLURALITY OF CONTACT PINS

DESCRIPTION

TECHNICAL FIELD

This invention generally relates to electrical connectors and more particularly to connectors of the mating plug and the receptacle type that use contact pin and socket connectors.

BACKGROUND ART

Electrical connectors of the mating plug and receptacle type having pin and socket connectors have been widely used. One application of such connectors is in the trucking industry where such a connector is commonly used to supply electric power and signals to a trailer from a truck. Typically, when a truck is hitched to a trailer, a connector is also attached and locked in place to prevent accidental disengagement while the truck is in operation.

Prior art connectors have not been completely satisfactory because the known structures have frequently required a complicated connecting procedure in order to insure that the connector does not become disconnected during operation. Frequently, the driver of the truck must use both hands and a substantial amount of force in order to insert and lock a plug in a receptacle on a trailer.

Further, prior art connectors have not been easy to disconnect when the truck is unhitched from the trailer. Often, both hands and a substantial amount of force must be used.

Thus, there has been a long felt need in the trucking industry for an electrical connector that provides both easy connection and removal while insuring that once installed the connector remains locked in place.

The present invention is directed to overcoming one or more of the problems as set forth above.

DISCLOSURE OF THE INVENTION

In one aspect of the present invention an electrical plug for a receptacle having a plurality of contact pins is contemplated. The electrical plug comprises a non-conductive body having a plurality of longitudinally aligned orifices therein and a plurality of resiliently deformable socket contact assemblies received in the orifices. The body and the socket contact assemblies are housed within a shield. A plurality of non-conductive followers are received in the body and engaged by the shield so that the followers deform the resilient contact assemblies to frictionally engage the contact pins of the receptacle.

The present invention solves the technical problem of securely locking an electrical connector in place by utilizing a plurality of followers that are actuated by an L-shaped cam surface. When the plug is moved longitudinally away from the receptacle, the receptacle contact pins are more tightly engaged.

The present invention also solves the problem of conveniently coupling and uncoupling a connector. During the process of connection the shield of the plug is rotated relative to the body and thereafter the shield is moved longitudinally with respect to the body.

Other aspects, objects and advantages of this invention can be obtained from a study of the drawings, the disclosure and the appended claims.

BRIEF DESCRIPTION OF THE DRAWINGS

FIG. 1 is a perspective view of a partially assembled electrical plug according to one embodiment of the present invention.

FIG. 2 is a perspective view of a receptacle for the plug of FIG. 1.

FIG. 3 is a side elevational view partially broken away of the plug of FIG. 1 in cross section along line III—III.

FIG. 4 is an enlarged perspective view which is broken away illustrating the cam surface within the plug of FIG. 1.

FIG. 5 is a side elevational view partially in section of the plug of FIG. 1 and the receptacle of FIG. 2. A portion of the sidewall of the shield of the plug is shown removed and rotated to illustrate its inside surface and the position of the follower on the cam surface prior to insertion of the plug into the receptacle. The receptacle dust cover has been removed for clarity.

FIG. 6 is an end elevational view of the receptacle of FIG. 5 prior to insertion of the plug. The receptacle dust cover has been removed for clarity.

FIG. 7 is an end elevational view of the receptacle of FIG. 6 after longitudinal insertion of the plug of FIG. 5. The receptacle dust cover has been removed for clarity.

FIG. 8 is an end elevational view of the receptacle of FIG. 6 after rotation of the shield of the plug. The receptacle dust cover has been removed for clarity.

FIG. 9 is a side elevational view of the receptacle and plug of FIG. 8. A portion of the sidewall of the shield of the plug is shown removed and rotated to illustrate its inside surface and the position of the follower on the cam surface after insertion of the plug and after rotation of the shield with respect to the receptacle. The receptacle dust cover has been removed for clarity.

FIG. 10 is a side elevational view of the receptacle and plug of FIG. 9 after the shield has been longitudinally moved away from the receptacle. A portion of the sidewall of the shield of the plug is shown removed and rotated to illustrate its inside surface and the position of the follower on the cam surface after insertion, rotation and partial withdrawal. The receptacle dust cover has been removed for clarity.

BEST MODE FOR CARRYING OUT THE INVENTION

Referring to the figures, FIG. 1 illustrates an electrical plug 10 for a receptacle having a plurality of contact pins. The plug comprises a body 12 having the shape of a right circular cylinder with a cylindrical sidewall 13, a front end wall 14 and a rear end wall 15. The body is fabricated from a hard, electrically non-conductive material that can withstand a substantial amount of wear and tear. The body contains a plurality of orifices 16 that penetrate longitudinally through it and that register with the receptacle contact pins as described below. Each orifice contains a socket contact assembly 18 that includes two resiliently deformable leaves 19 that engage the receptacle contact pins and a bolt 20 that secures a conductor 21 to the assembly to insure satisfactory electrical contact. Each contact assembly is fabricated from an electrically conductive material such as copper or steel. The assemblies are positioned within the orifices 16 so as to receive the contact pins which enter the body 12 through the front end wall 14. The socket contact assemblies 18 are also positioned in the orifices so that the electrical cable 23 with its plurality of conductors 21 can be attached to the socket contact assemblies 18 at the rear end wall 15 of the body by the bolts 20.

Referring to FIGS. 1 and 3, the body 12 also contains a plurality of movable followers 25 in the sidewall 13. These followers are electrically non-conductive and are each located along a radial axis of the body near the front end wall 14. In one embodiment the follower 25 consists of a metal sphere 26 that is received in a contoured non-electrically conductive seat 27 as illustrated in FIG. 3. In other embodiments, the follower may be unitary, non-electrically conductive elements or other means may be used to insure that the followers are not part of an electrically conductive path between socket contact assemblies 18. Each follower in the body engages a leaf 19 of one of the socket contact assemblies 18 in the circular array of orifices 16 and can deform it by pressing against it. The followers are free to move in and out along a radial axis guided by a cam surface described below. In the embodiment actually constructed there is no follower corresponding to the socket contact assembly in the center of the body 12.

Referring to FIG. 1, the electrical plug 10 also includes a shield 30, preferably made of metal, which houses the body 12. The shield has the shape generally of a right circular cylinder with an inner sidewall 31, an outer sidewall 32, a front end wall 38, and a rear end wall 39. The shield has an annular cross section so that the cylindrical body 12 can be received therein. The shield further includes a handle 33 which is grasped by the operator when inserting and removing the plug 10 from the receptacle. The electrical plug 10 is constructed so that the body 12 and the shield 30 can be rotated relative to each other about the longitudinal axis of the plug. The shield 30 contains a plurality of L-shaped orifices 34 in its sidewall that guide this motion. A plurality of bolts 35, only one of which is illustrated, on the sidewall 13 of the body 12 project from the body into the L-shaped orifices so that the relative motion between the body and the shield is restricted.

A collar or cable clamp 36 is fixed to the exterior of the cable 23 at a point spaced from the front endwall 14 of the body 12 by a distance greater than the axial length of the shield 30. Thus, the collar 36 will abut the rear endwall 39 of the shield 30 about the cable 23, when the body 12 is mounted within the shield 30 by means of the bolts 35 through the L-shaped orifices 34, with sufficient slack in the conductors 21 to accomodate the restricted relative rotational and axial motion between the body 12 and shield 30 permitted by the orifices 34 and bolts 35.

Referring to FIGS. 1 and 4, the shield 30 contains a plurality of identical cam surfaces 37 on the inner sidewall 31 which actuate the followers 25. FIG. 4 is a portion of the sidewall of the shield which has been broken away and is shown in cross section in order to illustrate the orientation and contour of one of the cam surfaces 37. In the preferred embodiment the cam surface is a generally L-shaped depression in the inner sidewall 31 of the shield. The cam surface has one leg 40 that is generally parallel with the longitudinal axis of the plug 10 and terminates near the front end wall 38. The cam surface also has a medial portion 42 and a second leg 41. The second leg is located in the arcuate portion of the shell and has an axis that is parallel with the rear end wall 39 of the shield.

The profile of the cam surface 37 is illustrated in FIG. 4. In general the deepest portion of the depression is at the end of the second leg 41 and the shallowest is at the end of the first leg 40. The depression becomes increasingly shallow when going from the end of the second leg 41 to the end of the first leg 40. One exception is a small rise in the cam surface in the second leg 41 that establishes an indexing position for the plug at the medial point 42 as described below. The contour of the cam surface is such that as the followers 25 move from the end of the second leg 41 to the medial point 42 and on to the end of the first leg 40, the followers are increasingly actuated toward the center of the body 12. This motion of the followers in turn tends to push the leaves 19 of the socket contacts 18 together and, if a contact pin is in the orifice, to cause the contacts 18 to more tightly engage the pins 46. The followers 25 are constrained to move along the L-shaped cam surface 37 by the bolts 35 which move in the L-shaped orifices 34 in the sidewall of the shield 30.

Referring to FIG. 2, the electrical plug 10 is inserted into a receptacle 44 of conventional construction. The receptacle includes a well area 45 that contains a plurality of longitudinally aligned contact pins 46. These contact pins, when the plug 10 is inserted in the receptacle, are received in the socket contact assemblies 18, FIG. 1. In the sidewall of the receptacle is a guide slot 47 which aids in indexing the electrical plug 10 with respect to the receptacle. The receptacle further includes a mounting plate 48 which rigidly secures the receptacle to a mounting (not shown). The well 45 is protected by a dust cover 49 that is urged to a position covering the well by a spring 50. The dust cover further includes a tab 52 which may be opened by a hook-shaped member 53, FIG. 1, on the outer sidewall 32 of the shield 30. The operator holds the electrical plug by the handles 33 and opens the receptacle by engaging the tab 52 with the hook shaped member 53. The outer sidewall of the shield also includes a plurality of guide members 54, FIG. 1, that engage the guide slot 47 and which are captured by a locking finger 55 on the wall of the dust cover 49. The finger 55 is urged by the spring 50 against the sidewall of the shield and tends to lock the electrical plug 10 in the receptacle 44 after insertion.

INDUSTRIAL APPLICABILITY

It is contemplated that the electrical connector described herein can be used in any application where a mating plug and a receptacle incorporating a plurality of pin and socket connectors are used. One application of this connector is for supplying electrical power and signals from a truck to a trailer. The receptacle 44, FIG. 2, is rigidly mounted on the front of the trailer and the plug 10, FIG. 1, is attached to a cable 23 containing a plurality of electrical conductors 21 leading from the truck. When the truck is hitched to the trailer, the plug 10 is inserted into the receptacle 44.

FIGS. 5 and 6 illustrate the receptacle 44 and the electrical plug 10 immediately prior to insertion of the plug into the receptacle. The dust cover 49 has been removed in FIGS. 5–10 for clarity. The bolt 35 on the body 12 is located near the end 57 of the L-shaped orifice 34 in the shield 30. In this position, each follower 25 is located in the deepest portion of the cam surface 37 at the end of the second leg 41. Since each follower is in the deepest portion of the depression, the followers do not bear against the leaves 19 of the socket contact assemblies 18 and thus the contact assemblies are in the most open position.

FIG. 7 illustrates the electrical plug 10 just after insertion of the plug into the receptacle 44. It should be noted in FIG. 7 that the guide member 54 is positioned against the left hand edge of the guide slot 47 and the plane of the handle 33 is tilted counterclockwise from the horizontal. The electrical plug is inserted into the receptacle in a longitudinal direction without rotation and the contact pins 46 in the well area 45 of the receptacle 44 are each received in a corresponding orifice 16 in the body 12 of the electrical plug. The contact pins come into both physical and electrical contact with the associated socket contact assemblies in the orifices.

Referring to FIGS. 7, 8 and 9, after the electrical plug 10 has been inserted into the receptacle 44, the shield 30 is rotated with respect to the receptacle about the longitudinal axis in a clockwise direction as illustrated in FIG. 8. The body 12, FIG. 1, remains stationary because of the insertion of the contact pins 46 into the orifices 16. Referring to FIG. 9, the shield 30 rotates with respect to the body 12 so that the end 57 of the L-shaped orifice 34 moves away from the bolt 35 and the medial position 58 of the orifice approaches the bolt. This rotation causes the cam surface 37 on the inner sidewall of the shield 30 to move with respect to the followers 25 so that each follower moves from the end of the second leg 41 of the cam surface 37, FIG. 4, over the rise 61 and into the indexing position at the medial position 42 of the depression. The slight elevation or rise 61 in the second leg of the cam surface 37 tends to prevent accidental relative rotation from the medial position 42 of the shield 30 with respect to the body 12. Since the followers 25 have moved to a shallower portion of the cam surface 37, the followers tend to press the leaves 19 in each socket contact assembly 18 together and thereby frictionally engage the contact pins 46 of the receptacle 44.

The electrical plug 10 is finally seated in place in the receptacle 44 by slightly withdrawing the shield 30 in a longitudinal direction away from the receptacle 44 and the body 12. This longitudinal motion moves the shield 30 relative to the body 12 so that the L-shaped orifice 34 moves relative to the bolt 35 until the bolt approaches the end 59 of the orifice. This motion of the shield 30 causes the cam surface 37 to move relative to the followers 25. Referring to FIG. 4, the followers move from the medial position 42 of the cam surface toward the end of the first leg 40 and into an increasingly shallower portion of the depression. The followers are thereby pressed more tightly against the leaves 19 of the socket contact assemblies 18 which in turn more tightly engage the contact pins 46 of the receptacle 44. The frictional engagement between the contact pins 46 and the socket contact assemblies 18 locks the electrical plug 10 in the receptacle 44 and prevents accidental or inadvertent separation. Accidental disengagement is further prevented by the finger 55, FIG. 2, on the dust cover which engages the guide member 54, FIG. 1 on the electrical plug 10.

It should be appreciated that once the electrical plug 10 is completely seated in the receptacle as shown in FIG. 10, further longitudinal motion of the shield 30 relative to the body 12 away from the receptacle such as by pulling the collar 36 on the cable 23 against the endwall 39 of the shield 30 causes the contact pins to be even more tightly engaged by the plug.

The electrical plug 10 is removed from the receptacle 44 by first pushing the shield 30 longitudinally into the well 45 of the receptacle, then rotating the shield relative to the body 12 and thereafter withdrawing the shield and body together from the receptacle in a longitudinal motion away from the well. These three motions are exactly reversed to the inserting process described above and for brevity need not be explained in detail.

In view of the foregoing, it can be seen how an electrical plug according to the present invention solves the problem of securing an electrical connector in place against inadvertent separation and how the problem of conveniently coupling and uncoupling an electrical connector can be solved.

Other aspects, objects and advantages of this invention can be obtained from a study of the drawings, the disclosure and the appended claims.

I claim:

1. An electrical plug for a receptacle having a plurality of contact pins, comprising:

(a) an electrically non-conductive body having the shape generally of a right circular cylinder with a longitudinal axis and having a plurality of longitudinally aligned orifices therein;

(b) a plurality of socket contact assemblies received in said orifices, said assemblies each being resiliently deformable and each connectable to an electrical conductor;

(c) a shield which houses said body and said socket contact assemblies having an annular shape with an inner side wall, said body and said shield being relatively movable with respect to each other, said inner side wall of said shield having a cam surface thereon defining a depression of varying depth, and (d) a plurality of followers radially received in said body and engaged by said cam surface of said shield to deform said resilient contact assemblies against said contact pins of said receptacle a variable amount depending on the relative position of said shield and said body.

2. An electrical plug as in claim 1 wherein the cam surface is aligned and contoured so that as the shield is moved longitudinally away from a receptacle, the contact assemblies are deformed to engage the contact pins of the receptacle more firmly.

3. An electrical plug as in claim 1 wherein the shield and body are both relatively rotatable and longitudinally movable with respect to each other and wherein the cam surface is generally L-shaped with both longitudinal and arcuate portions.

4. An electrical plug as in claim 3 wherein:

(a) the body has a front end wall through which receptacle contact pins can pass and a rear end wall at which the socket contact assemblies are connectable to an electrical cable; and (b) the L-shaped cam surface is aligned with the free end of the longitudinal portion of the "L" nearer the front end wall and with the arcuate portion of the "L" nearer the rear end wall.

5. An electrical plug as in claim 4 wherein the L-shaped cam surface is a depression in the inner side wall of the shield, said depression becoming increasingly more shallow from the free end of the arcuate portion of the "L" to the free end of the longitudinal portion of the "L".

6. An electrical plug as in claim 1 wherein said shield is made of metal and wherein non-electrically conductive means is provided to prevent electrical current flow from said socket contact assemblies to said shield through said followers.

7. An electrical plug as in claim 6 wherein each follower includes a spherical metal bearing and a non-conductive seat having a recess therein for retaining said bearing, said bearing engaging the shield and said seat engaging a socket contact assembly.

8. An electrical plug as in claim 1 wherein said shield has an exterior side wall with a hook shaped member thereon for opening receptacle dust covers.

* * * * *